US005778965A

United States Patent [19]

Mai

[11] Patent Number: 5,778,965

[45] Date of Patent: Jul. 14, 1998

[54] STACKED MOLD

[75] Inventor: Sumitoshi Mai, Kashiwazaki, Japan

[73] Assignees: Kabushiki Kaisha Riken, Tokyo; Riken Castec Corporation, Kashiwazaki, both of Japan

[21] Appl. No.: 746,566

[22] Filed: Nov. 13, 1996

[30] Foreign Application Priority Data

Nov. 17, 1995 [JP] Japan ..... 7-322513

[51] Int. Cl.[6] ..... B22C 9/20

[52] U.S. Cl. ..... 164/322; 164/27; 164/350

[58] Field of Search ..... 164/18, 322, 323, 164/324, 330, 364, 350, 23, 27

[56] References Cited

U.S. PATENT DOCUMENTS 4,241,492 12/1980 Hedberg ..... 29/527.6

5,450,665 9/1995 Madono et al. ..... 29/888.1

FOREIGN PATENT DOCUMENTS

| | | |
|---|---|---|
| 0 640 418 A1 | 3/1995 | European Pat. Off. . |
| 636096 | 4/1950 | United Kingdom . |
| 907949 | 10/1962 | United Kingdom . |
| 2277284 | 10/1994 | United Kingdom . |

*Primary Examiner*—Kuang Y. Lin

*Attorney, Agent, or Firm*—Kubovcik & Kubovcik

[57] ABSTRACT

The sand-metal ratio of a mold used for casting a crank shaft or cam shaft having discrete shapes is reduced to make the mold more compact. Basic discrete cavities (15) including cavities (6) corresponding to one half of shaft portions and cavities (7) corresponding to one half of cam portions are staggered by axially offsetting them in horizontal and/or vertical direction.

2 Claims, 5 Drawing Sheets

STACKED MOLD

BACKGROUND OF THE INVENTION

The present invention relates to a stacked mold used for casting shafts and the like having discrete cavities formed at predetermined pitches.

Castings have an advantage in that they are highly adaptable to various designs and can follow any three-dimensional shapes. For example, among members for multi-cylinder internal combustion engines, crank shafts or cam shafts having discrete shapes at pitches between the cylinders are manufactured by means of casting.

Mass production type castings are generally manufactured using a green sand high pressure mold or chemically hardened mold, and a plurality or multiplicity of castings are provided depending on the characteristics of the molds and limitations on the required running and rising systems for molten metal. A shaft having discrete shapes suffers from a low output productivity as a casting because its discrete shapes make the effective cavity volume relative to the total volume of the molds smaller compared to those in casting of common mechanical elements, resulting in a high sand-metal ratio.

Casting utilizing chemical molds is employed to meet needs for near net shapes required from users of castings. In this case, cavities are provided by horizontally spreading green sand molds, which leaves a need for reducing the sand-metal ratio as a problem to be solved.

FIGS. 6 and 7 show an example of a shaft having discrete shapes. A cam shaft 1 comprises a shaft portion 2, cam portions 3 at predetermined pitches which are circular in the illustrated example, and a journal portion 4. FIGS. 8–10 show an example of a stacked mold 5 used for casting the cam shaft 1 as described above.

The mold 5 has been molded from chemically hardened sand 11 to have, on upper and lower parting surfaces thereof, half shaft portion cavities 6 corresponding in shape to one half of shaft portions 2, half cam portion cavities 7 corresponding in shape to one half of cam portions 3 at predetermined pitches, and half journal portion cavities 8 corresponding in shape to one half of journal portions 4. The upper and lower cam portion cavities 7 are arranged in parallel so that their peripheral surfaces are as close to each other between adjacent cam portion cavities 7 and between upper and lower cam portion cavities 7. The mold is formed in the conventional manner.

However, the sand-metal ratio of this mold can not be small because of its great height (H) and width. It is therefore an object of the invention to solve such a problem with conventional molds.

SUMMARY OF THE INVENTION

In FIG. 6, the thickness (a) of the cam portions is shown smaller than the dimension (b) between the cam portions. Taking this into consideration, a plurality of sets of cavities are geometrically displaced in parallel in an axial direction on a horizontal or vertical plane or on both horizontal and vertical planes to be staggered with each other to form a stacked cubic array of molds in which intervals between the cavities are reduced.

The reduced total volume of the molds allows the sand-metal ratio to be minimized, and an increase in an effective spatial volume of the cavities occupied in the total volume of the molds configured as a cubic element can significantly help to improve the efficiency of casting steps in all aspects.

Specifically, according to the present invention, there is provided a stacked mold comprising molds formed with, on upper and lower parting surfaces thereof, basic discrete cavities comprising a plurality of cavities corresponding to one half of shaft portions having axes in parallel with each other and a plurality of cavities corresponding to one half of cams formed at predetermined pitches in the radial direction of the shaft cavities, the basic discrete cavities being axially offset from each other at least in a lateral or longitudinal direction so that a cavity corresponding to a cam is positioned between adjacent cavities corresponding to cams.

DETAILED DESCRIPTION OF PREFERRED EMBODIMENTS

Figure 1:
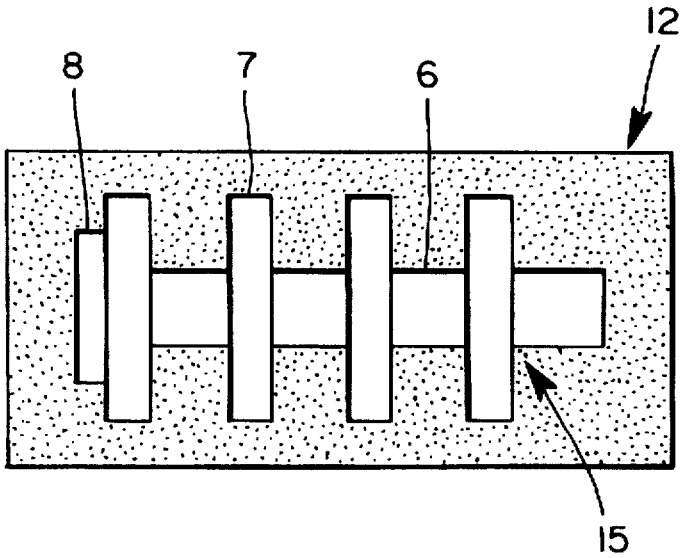
FIG. 1 is a plan view of a mold of an embodiment of the present invention.
Figure 2:
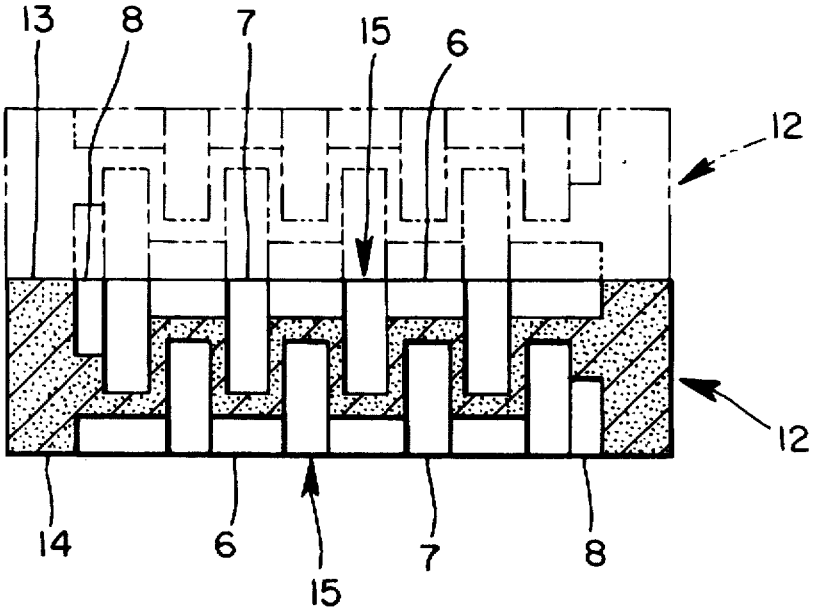
FIG. 2 is a sectional view of the embodiment shown in FIG. 1.

An embodiment of the present invention will now be described with reference to FIGS. 1 and 2. A stacked mold 12 consists of chemically hardened molds which are vertically stacked and have upper and lower surfaces 13, 14 which are formed with a basic discrete cavity 15 comprising a cavity 6 corresponding to one half of a shaft portion of a cam shaft, cavities 7 corresponding to one half of cam portions, and a cavity 8 corresponding to one half of a journal portion. The chemically hardened mold is formed in the conventional manner. The lower basic discrete cavity 15 is axially offset from the upper basic discrete cavity 15 so that a lower half cam portion cavity 7 is positioned between a pair of upper half cam portion cavities 7. This makes it possible to reduce the height of the mold 12, thereby allowing the sand-metal ratio to be improved.

Figure 3:
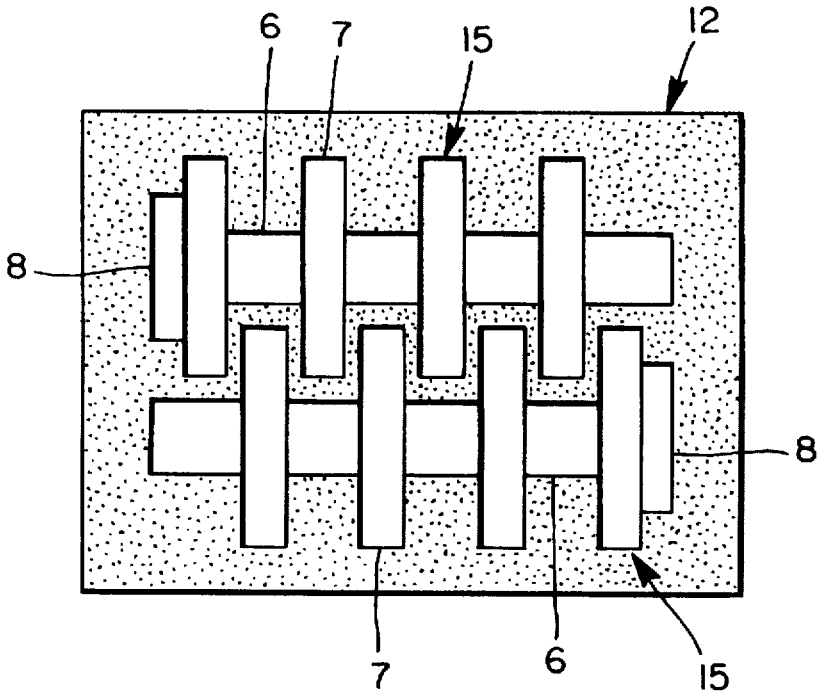
FIG. 3 is a plan view of another embodiment of the present invention.
Figure 4:
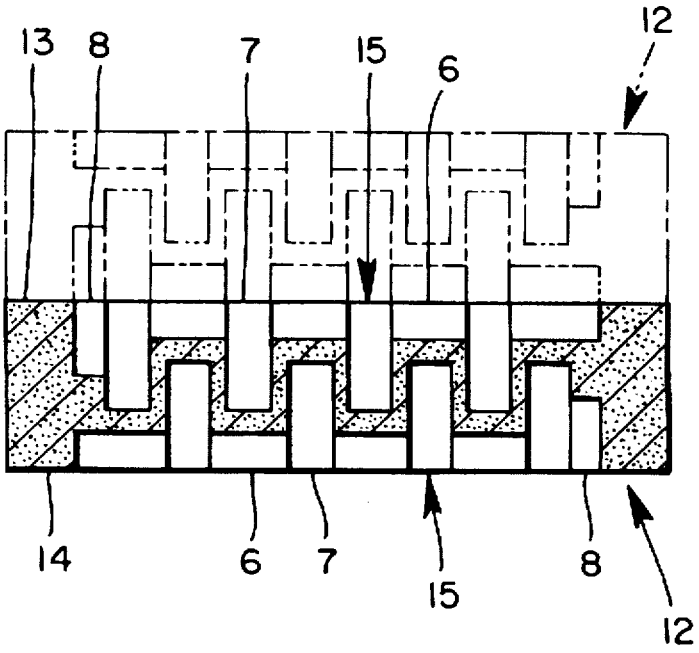
FIG. 4 is a longitudinal sectional view of the embodiment shown in FIG. 3.
Figure 5:
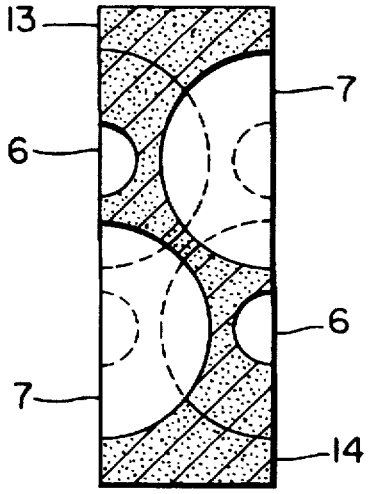
FIG. 5 is a lateral sectional view of the embodiment shown in FIG. 3.
Figure 6:
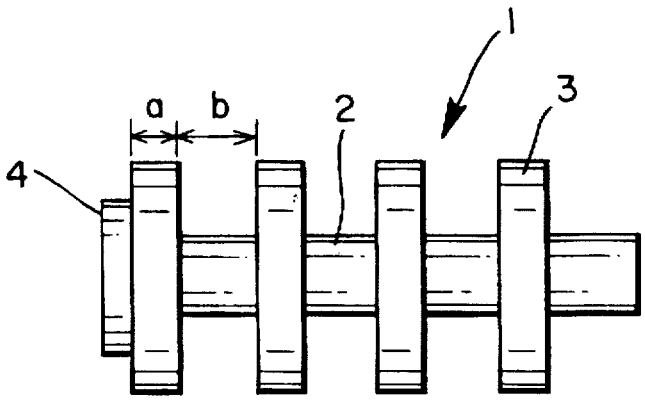
FIG. 6 is a front view of an example of a cam shaft.
Figure 7:
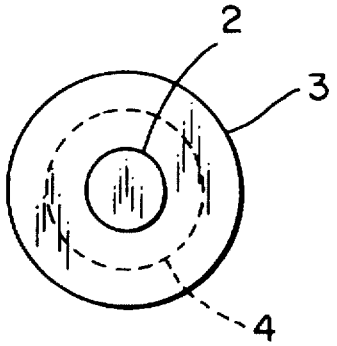
FIG. 7 is a side view of the example shown in FIG. 6.
Figure 8:
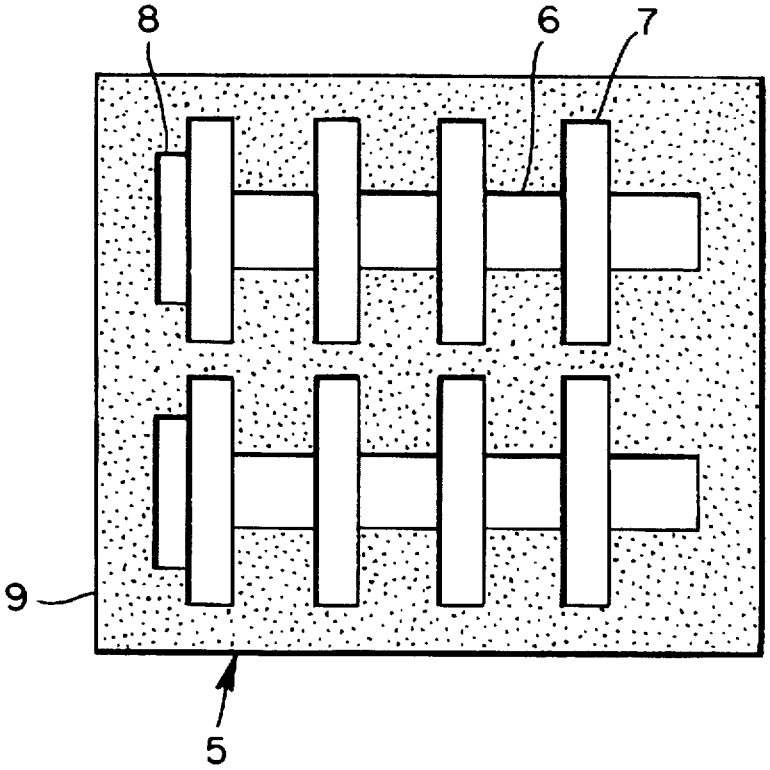
FIG. 8 PRIOR ART
FIG. 8 is a plan view of an example of a conventional mold.
Figure 9:
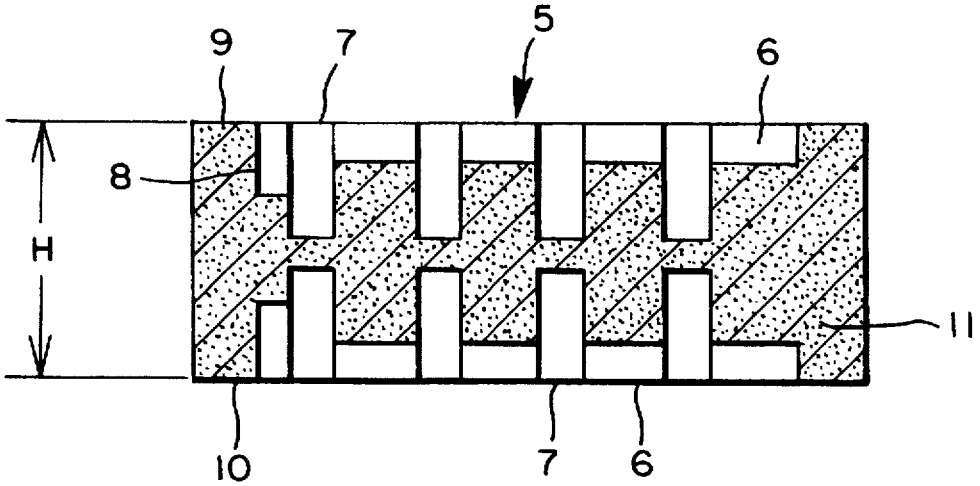
FIG. 9 PRIOR ART
FIG. 9 is a longitudinal sectional view of the example shown in FIG. 8.
Figure 10:
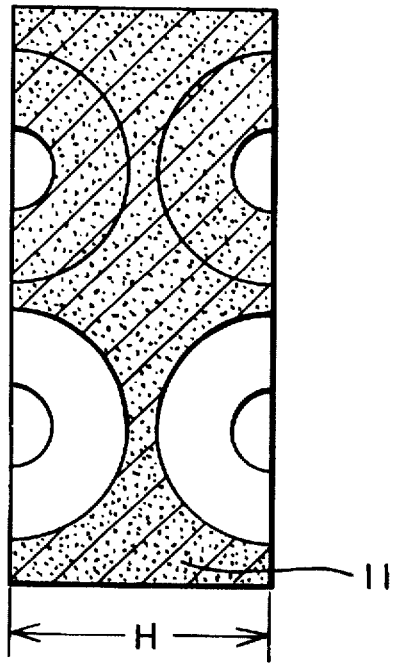
FIG. 10 PRIOR ART
FIG. 10 is a lateral sectional view of the example shown in FIG. 8.

In the embodiment shown in FIGS. 3–5, a plurality of basic discrete cavities 15 are horizontally arranged in parallel, and one group of half cam portion cavities 7 are positioned between another group of half cam portion cavities 7. The same number of basic discrete cavities 15 are arranged vertically to the horizontal parallel basic discrete cavities 15 so that a lower half cam portion cavity 7 is positioned between a pair of upper half cam portion cavities 7. As a result, as shown in FIG. 5, the horizontally and vertically arranged half cam portion cavities 7 are positioned between adjacent half cam portion cavities 7. That is, the basic discrete cavities 15 are axially offset from each other in the horizontal and vertical directions to stagger the half cam portion cavities 7. Such an arrangement makes it possible to reduce the height of the mold 12, thereby allowing the sand-metal ratio to be reduced.

The upper mold may be stacked on the lower mold so that the lower surface of the former is located over the upper surface of the latter as illustrated. Alternatively, the basic discrete cavities may be arranged symmetrically so that the upper mold is stacked on the lower mold so that the upper surface of the former is located over the upper surface of the latter. Further, the upper mold may be stacked on the lower mold after rotating it at an angle of 180 deg. There is no particular limitation on how to stack the molds.

When the profile of the discrete shapes and differences between diameters of phase axes are relatively small, lower cavities in a vertically staggered array vertically corresponding to an array of a plurality of horizontally staggered close upper cavities on a horizontal plane can be configured to form an isosceles triangle or equilateral triangle when the central points of cross sections of those cavities are connected.

According to the present invention, a plurality of basic discrete cavities are axially displaced in parallel to stagger half cam portion cavities with each other. As a result, the intervals between the cavities can be reduced. This makes it possible to achieve a small sand-metal ratio, thereby allowing a mold to be more compact.

While specific illustrated embodiments have been shown and described, it will be appreciated by those skilled in the art that various changes and modifications may be made to the invention without departing from the spirit and scope of the invention as set forth in the appended claims.

What is claimed is:

1. A stacked mold comprising molds formed with, on upper and lower parting surfaces thereof, basic discrete cavities comprising a plurality of cavities corresponding to one half of shaft portions having axes in parallel with each other and a plurality of cavities corresponding to one half of cams formed at predetermined pitches in the radial direction of said cavities corresponding to shaft portions, said basic discrete cavities being axially offset from each other at least in a vertical direction so that a cavity corresponding to one half of a cam in a basic discrete cavity is positioned between a pair of cavities in an adjacent basic discrete cavity of the stacked molds, each cavity of said pair of cavities corresponding to one half of a cam.

2. A stacked mold according to claim 1, wherein a plurality of said basic cavities are arranged in horizontal and vertical directions.

* * * * *